US009038222B2

(12) United States Patent
Cicci

(10) Patent No.: US 9,038,222 B2
(45) **Date of Patent: *May 26, 2015**

(54) CRIB SAFETY PRODUCTS

(71) Applicant: Babee Talk IP Holdings Inc., Oakdale, PA (US)

(72) Inventor: Jennifer Cicci, Oakdale, PA (US)

(73) Assignee: BABEE TALK IP HOLDINGS INC., Oakdale, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/181,914

(22) Filed: Feb. 17, 2014

(65) Prior Publication Data

US 2014/0157520 A1 Jun. 12, 2014

Related U.S. Application Data

(62) Division of application No. 13/652,592, filed on Oct. 16, 2012, now Pat. No. 8,689,379.

(60) Provisional application No. 61/549,479, filed on Oct. 20, 2011, provisional application No. 61/549,937, filed on Oct. 21, 2011, provisional application No. 61/628,001, filed on Oct. 21, 2011, provisional application No. 61/586,953, filed on Jan. 16, 2012.

(51) Int. Cl.
*A47D 15/00* (2006.01)
*A47C 21/08* (2006.01)

(52) U.S. Cl.
CPC ..... *A47D 15/008* (2013.01); *A47C 21/08* (2013.01)

(58) Field of Classification Search
CPC ... A47D 15/005; A47D 15/008; A47C 21/08; A61G 7/0525; A61G 2007/0522
USPC ..... 5/93.1, 98.1, 424, 663, 946; 248/345.1; 297/225, 227, 228.13
See application file for complete search history.

(56) References Cited

U.S. PATENT DOCUMENTS 799,390 A 9/1905 Kuykendall
2,025,613 A 12/1935 Rohan (Continued)

FOREIGN PATENT DOCUMENTS

FR 1138138 A 6/1957
FR 2769479 A1 4/1999

(Continued)

OTHER PUBLICATIONS

"Crown Crafts Infant Products to Unveil Innovative Crib Liner at Ninth Annual ABC Kids Expo", dated Sep. 20, 2011, 2 pages.

(Continued)

*Primary Examiner* — Michael Trettel
(74) *Attorney, Agent, or Firm* — Brown & Michaels, PC

(57) ABSTRACT

A bumper pad includes a base attached to a material that extends over the rail and couples as a crib teething rail cover. The bumper pad includes a base, mesh sides, and a teething rail cover. In some embodiments, the sides are separable from the base. In some embodiments, the teething rail cover is separable from the mesh sides. In still other embodiments, the sides are separable from the base and the teething rail cover is separable from the sides. A rail cover includes a rail cover base and at least one pair of fastener straps extending from one side of the rail cover base. The rail cover may also include tie straps and corresponding slits, fastener pads, or loops on the rail cover base. Methods of assembly of the bumper pad and rail cover are also disclosed.

20 Claims, 16 Drawing Sheets

(56) References Cited

U.S. PATENT DOCUMENTS

| | | | |
|---|---|---|---|
| 2,600,556 | A | 6/1952 | Malm |
| 3,018,492 | A | 1/1962 | Rosen |
| 3,438,069 | A | 4/1969 | Long |
| 3,627,251 | A | 12/1971 | Paulison |
| 3,742,530 | A | 7/1973 | Clark |
| 4,089,497 | A | 5/1978 | Miller et al. |
| 4,370,765 | A | 2/1983 | Webber |
| 4,523,745 | A | 6/1985 | Killman et al. |
| 4,710,992 | A | 12/1987 | Falwell et al. |
| 4,767,419 | A | 8/1988 | Fattore |
| 4,811,437 | A | 3/1989 | Dillner et al. |
| 5,163,197 | A | 11/1992 | Armstrong et al. |
| 5,172,435 | A | 12/1992 | Griffin et al. |
| 5,197,154 | A | 3/1993 | Shamie |
| 5,410,765 | A | 5/1995 | Youngblood |
| 5,421,046 | A | 6/1995 | Vande Streek |
| 5,437,071 | A | 8/1995 | Feigenbaum |
| D365,957 | S | 1/1996 | Ferrari |
| 5,542,135 | A | 8/1996 | Ozrovitz et al. |
| 5,581,827 | A | 12/1996 | Fong et al. |
| 5,605,374 | A | 2/1997 | Perry |
| 5,642,545 | A | 7/1997 | Howard |
| 5,700,053 | A | 12/1997 | Downing |
| 5,845,349 | A | 12/1998 | Tharalson et al. |
| 5,867,853 | A | 2/1999 | Feld |
| 5,881,408 | A | 3/1999 | Bashista et al. |
| 5,898,964 | A | 5/1999 | Stanley |
| 5,926,873 | A | 7/1999 | Fountain |
| 5,937,458 | A | 8/1999 | DeRosa |
| 6,170,101 | B1 | 1/2001 | McCloud |
| D444,329 | S | 7/2001 | Newman |
| 6,301,731 | B1 | 10/2001 | Jakubowski et al. |
| 6,401,281 | B1 | 6/2002 | Younge |
| 6,421,857 | B2 | 7/2002 | Whatman et al. |
| 6,438,775 | B1 | 8/2002 | Koenig |
| 6,604,789 | B1 | 8/2003 | Downing |
| 6,687,927 | B1 | 2/2004 | Tharalson et al. |
| 6,742,751 | B1 | 6/2004 | DeMoor |
| 6,772,457 | B1 | 8/2004 | Alaback |
| 7,003,823 | B1 | 2/2006 | Reed et al. |
| 7,013,505 | B2 | 3/2006 | Martin |
| 7,055,192 | B2 | 6/2006 | Waters et al. |
| 7,406,725 | B2 | 8/2008 | Martin et al. |
| D575,975 | S | 9/2008 | Williamson |
| 7,431,396 | B1 | 10/2008 | Dasso |
| 7,458,114 | B2 | 12/2008 | Troutman |
| 7,523,513 | B2 | 4/2009 | Waters et al. |
| 7,716,760 | B1 | 5/2010 | Alaback |
| 7,793,368 | B2 | 9/2010 | Burrell, IV |
| 8,312,575 | B1 | 11/2012 | Maraj |
| 8,539,626 | B2 | 9/2013 | Dunne et al. |
| 8,689,379 | B2 * | 4/2014 | Cicci ..... 5/663 |
| 2008/0216233 | A1 | 9/2008 | Butlin |
| 2009/0211023 | A1 | 8/2009 | Cocco et al. |
| 2009/0313762 | A1 | 12/2009 | Boutwell et al. |
| 2010/0107338 | A1 | 5/2010 | Waters et al. |
| 2010/0257654 | A1 | 10/2010 | Waters et al. |
| 2011/0041253 | A1 | 2/2011 | Fiebrich et al. |
| 2011/0113552 | A1 | 5/2011 | Miller |

FOREIGN PATENT DOCUMENTS

| | | | |
|---|---|---|---|
| GB | 2295770 | A | 6/1996 |
| GB | 2351900 | A | 1/2001 |
| GB | 2378647 | A | 2/2003 |
| GB | 2397998 | A | 8/2004 |
| GB | 2416685 | A | 2/2006 |
| GB | 2456021 | A | 7/2009 |

OTHER PUBLICATIONS

"Leachco Easy Teether—Crib Rail Cover—White", available at http://www.diapers.com/p/leachco-easy-teether-crib-rail-cover-white-162067, Feb. 23, 2012, 2 pages.

"Use a Crib Teething Rail Guard for Safety", available at http://www.1st-babies.com/teething/Use_a_Crib_Teething_Rail_Guard_for_Safety.shtml, Nov. 22, 2011, 2 pages.

* cited by examiner

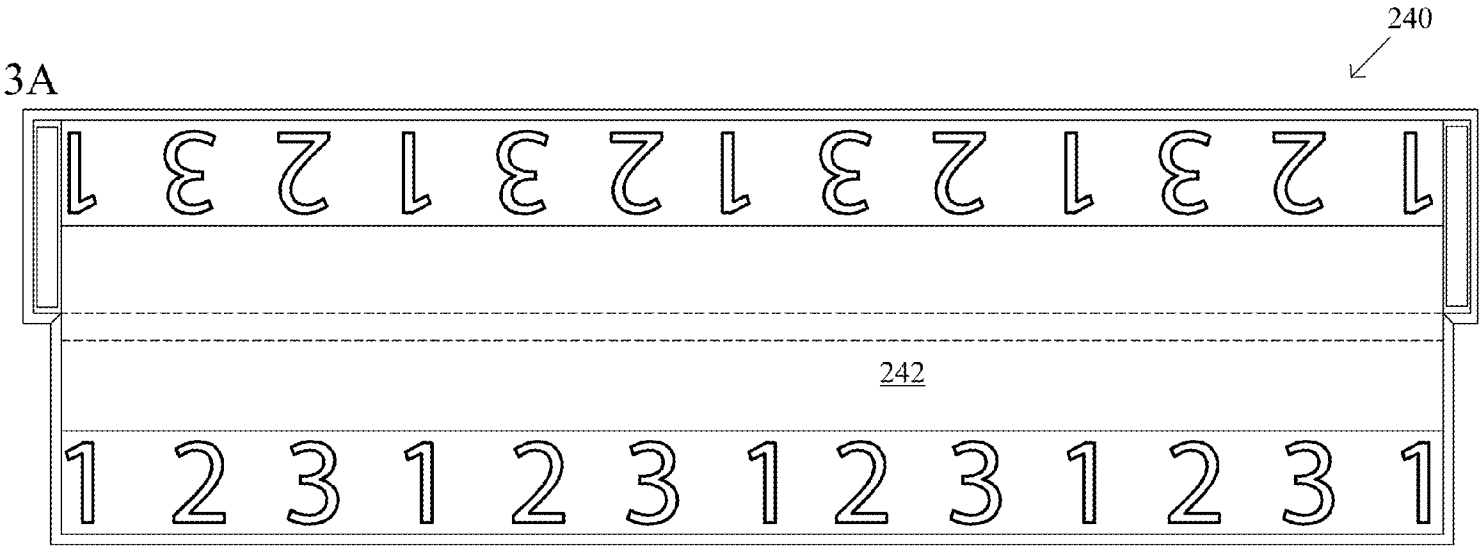
240
242
1 2 3 1 2 3 1 2 3

CRIB SAFETY PRODUCTS

REFERENCE TO RELATED APPLICATIONS

This is a divisional patent application of application Ser. No. 13/652,592, filed Oct. 16, 2012, entitled "CRIB SAFETY PRODUCTS", issued Apr. 8, 2014 as U.S. Pat. No. 8,689,379, which claims one or more inventions which were disclosed in Provisional Application No. 61/549,479, filed Oct. 20, 2011, entitled "CRIB BUMPER AND CRIB SAFETY PRODUCT", Provisional Application No. 61/549,937, filed Oct. 21, 2011, entitled "CRIB BUMPER AND CRIB SAFETY PRODUCT", Provisional Application No. 61/628,001, filed Oct. 21, 2011, entitled "CRIB BUMPER AND CRIB SAFETY PRODUCT", or Provisional Application No. 61/586,953, filed Jan. 16, 2012, entitled "CRIB BUMPER AND CRIB SAFETY PRODUCT". The benefit under 35 USC §119(e) of the United States provisional applications is hereby claimed, and the aforementioned applications are hereby incorporated herein by reference.

BACKGROUND OF THE INVENTION

1. Field of the Invention

The invention pertains to the field of crib safety products. More particularly, the invention pertains to a one piece bumper pad and a crib rail cover.

2. Description of Related Art

A crib bumper is a pad or cushion that lines the inside of an infant's crib. The bumper pads run the entire length of each side of the crib. Bumper pads were designed to prevent injury to a baby while sleeping or playing in a crib. Bumper pads are generally 8 inches to 11 inches high.

A crib rail cover goes over the top of the crib rail. The crib rail cover typically runs the entire length of the crib rail. Crib rail covers were designed to prevent babies, especially teething babies, from chewing on the crib rail, which is usually made of wood or a wood product.

SUMMARY OF THE INVENTION

A bumper pad includes a base attached to a material that extends over the rail and couples as a crib teething rail cover. The bumper pad includes a base, mesh sides, and a teething rail cover. A rail cover includes a rail cover base and at least one fastener strap extending from one side of the rail cover base. The rail cover may also include tie straps and corresponding slits, fastener pads, or loops on the rail cover base. In some embodiments, the sides are separable from the base. In some embodiments, the teething rail cover is separable from the mesh sides. In still other embodiments, the sides are separable from the base and the teething rail cover is separable from the sides. Methods of assembly of the bumper pad and rail cover are also disclosed.

In some embodiments, the crib safety product is a one-piece bumper pad including a base attached to a material that extends over the rail and also preferably acts as a crib teething rail cover. In some embodiments, the crib safety product includes a bumper base, which is secured under the mattress, and sides that extend up over the crib rails. In some embodiments, the crib safety product is a full-size, one-piece device that includes see-though padding that allows adequate airflow.

In other embodiments, the crib safety product is a crib teething rail cover. The crib rail cover includes at least one fastener strap including a pair of fastener strips fastened to and extending from the back side of the crib rail cover base. In some embodiments, the crib rail cover also includes at least one tie strap including a pair of tie strips fastened to and extending from the top edge of the crib rail cover base, and the crib rail cover base has at least one pair of openings through the crib rail cover base sized and located to receive the tie strips. In other embodiments, the crib rail cover includes at least one loop extending from the back side of the crib rail cover base, and the loop is sized and located to receive the fastener strap.

BRIEF DESCRIPTION OF THE DRAWINGS

FIG. 13A shows the front side of a long rail cover in an embodiment of the present invention.

FIG. 13B shows the back side of the long rail cover of FIG. 13A.

DETAILED DESCRIPTION OF THE INVENTION

Figure 1:
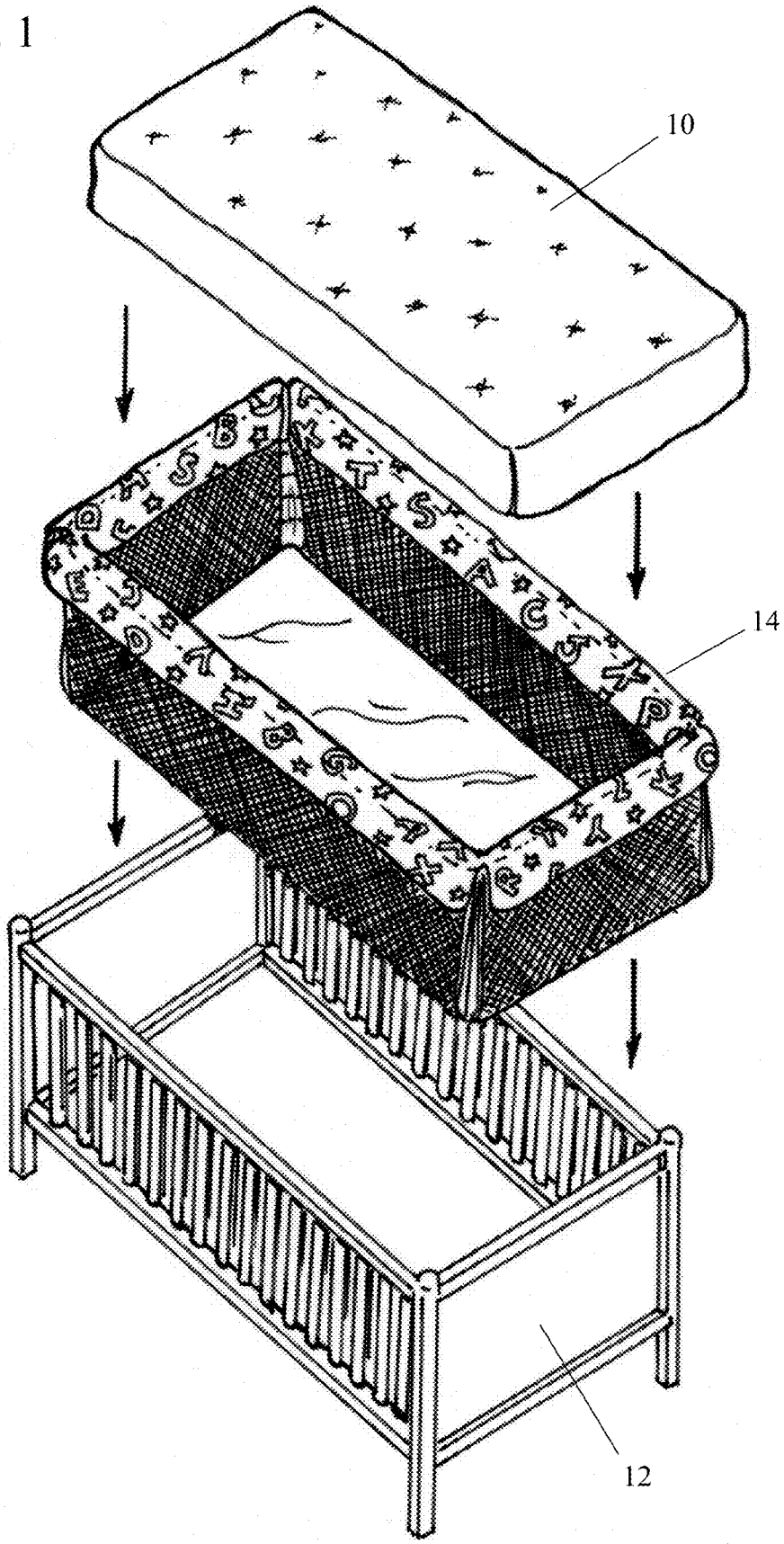
FIG. 1 shows an exploded view of a crib bumper, a mattress, and a crib in an embodiment of the present invention.

Crib safety product is used herein to describe a crib rail cover, a crib bumper, or a one-piece crib bumper design including a crib rail cover.

In some embodiments, the crib safety product is a one-piece bumper design. It goes from one side of the crib, secures under the mattress and goes up the other side and extends over the railing. It is preferably secured with hidden fasteners so that the fasteners are difficult for a child to access because of the location and by the presence of snaps or other hidden fasteners. The flaps preferably have stylish, educational designs including, for example, colored shapes, letters, numbers or animals.

In other embodiments, the crib safety product is a crib teething rail cover that may be used independently of the other parts of the one-piece bumper design embodiments. The crib rail cover includes at least one fastener strap including a pair of fastener strips fastened to and extending from the back side of the crib rail cover base. In some embodiments, the crib rail cover also includes at least one tie strap including a pair of tie strips fastened to and extending from the top edge of the crib rail cover base, and the crib rail cover base has at least one pair of openings through the crib rail cover base sized and located to receive the tie strips. In other embodiments, the crib rail cover includes at least one loop extending from the back side of the crib rail cover base, and the loop is sized and located to receive the fastener strap. The crib rail cover is placed over a rail of the crib and is fastened to the rail using the straps.

The crib safety products are preferably sized to fit standard cribs that are typically 30"×54" in size and standard crib mattresses that are typically 27⅝" to 28⅝"×51¾" to 53". In one embodiment, it is fastened at the seams, creating a box-shaped body and serves to create a completely enclosed area inside the crib. The bumper base is placed completely underneath the mattress and allows for a secure fit. Each side of the bumper is preferably made of a three-dimensional spacer fabric that is preferably just over one-fourth inch thick to provide a cushion for the baby, although other thicknesses that create sufficient cushioning are also possible. The upper and lower sides of this three-dimensional fabric are mesh. The middle is preferably a unique X-90 structure made of polyester, giving it outstanding durability, ventilation and washable functions. Since it is high quality Polyethylene terephthalate (PET), it is recyclable and eco-friendly. PET does not contain harsh chemicals and is approved by the FDA as a safe material. Since the middle structure of the mesh is preferably hollow, the front and back mesh allows for adequate ventilation. The see-through mesh also allows the parent to have full view of the child. Unlike most mesh materials made with formaldehyde or other harsh chemicals, the mesh used in the crib safety product described herein is preferably not processed with formaldehyde or other harsh chemicals.

One-Piece Bumper Pad

In some embodiments, the crib bumper is a one-piece bumper pad with a base and a material attached to the base that extends over the rail and preferably acts as a crib teething rail cover. The bumper (sides) area of the pad is preferably made of a breathable, mesh-like material. The mesh-like material is preferably made of mesh on the outside and hollow fibers on the inside allowing for adequate airflow, cushion and the see through factor. In one preferred embodiment, the mesh-like material is preferably made of a high quality, safe PET material. A recyclable mesh-like material that is made with minimal chemical additives and is formaldehyde-free is preferred. In a preferred embodiment, the mesh material is a 3-D spacer mesh, for example, a 3-D spacer mesh manufactured by Quanzhou Wellcool Cushion Technology Co. Ltd. (Quanzhou, China).

A crib skirt may also optionally be attached to the base. Although bumper pads are generally 8-11 inches high, the bumper pads described herein are unique in that they are attached to the base, which is secured under the mattress and extends up over the crib rails. The crib bumper is a full-size, one-piece design that includes see-though mesh-like padding that allows adequate airflow. The bumper can be used in most standard cribs (standard crib size is 54½"×27"×49½") or can be designed to fit other infant beds, including, but not limited to, bassinets, co-sleepers or portable cribs. In these alternative embodiments, the base and sides would be designed in a size and shape to fit into the alternative infant beds. The design can be changed to fit bassinets and other types of infant beds by changing the size and shape without sacrificing the amount of adequate air flow. The crib bumper described herein addresses many concerns in the industry regarding safety and comfort of bumper pads available on the market today. It is affordable, durable, easy to clean, comfortable, and safe.

FIG. 1 shows an exploded view of how the entire crib safety product 14 goes inside the crib 12 and onto the mattress 10. After the bumper is secured in place in the crib and to the crib sides, the mattress is put down on top of the bumper base.

Figure 2:
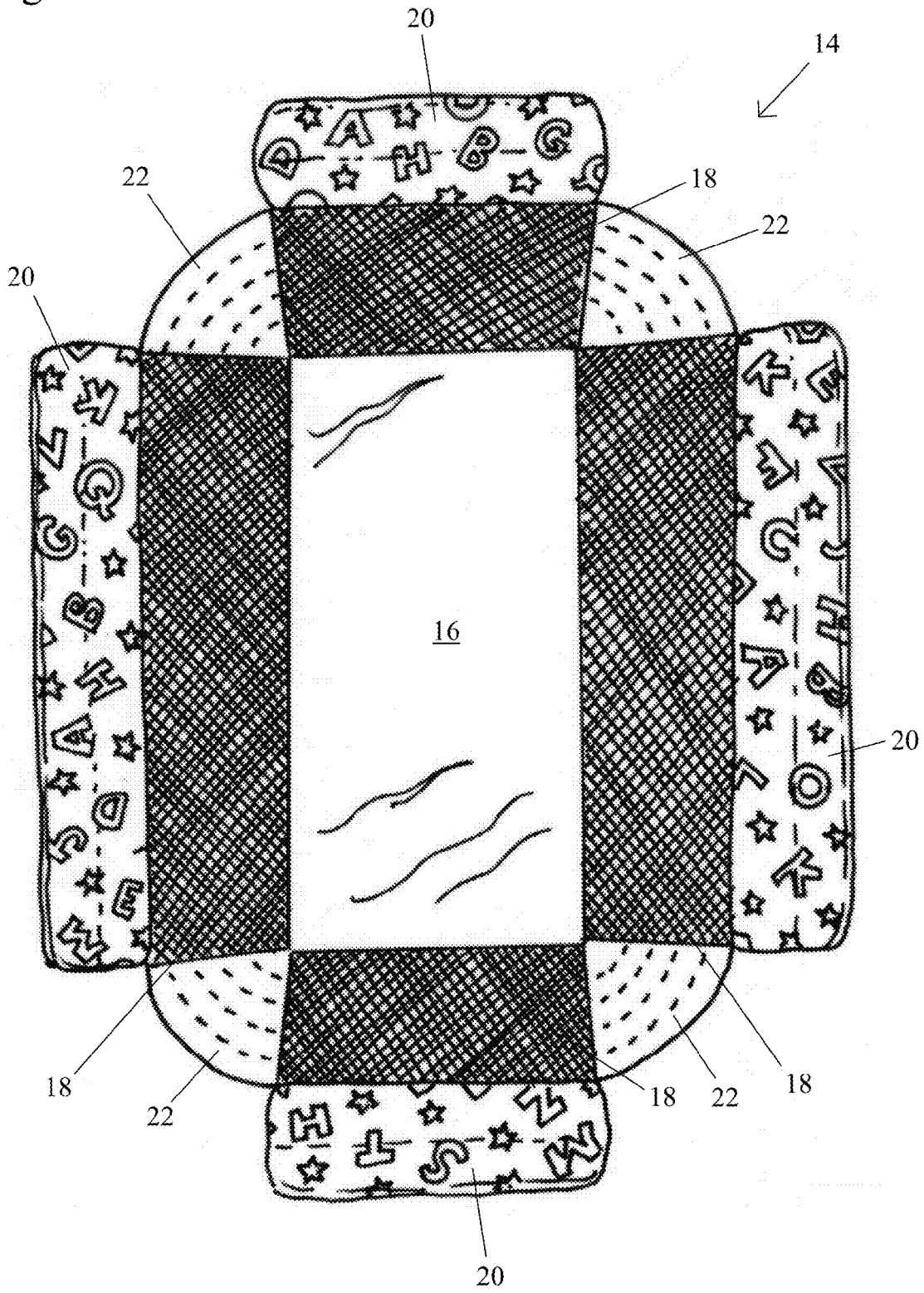
FIG. 2 shows a top view of the crib bumper of FIG. 1.

FIG. 2 shows a top view the crib safety product 14 laid on a flat surface. The crib safety product 14 includes a bumper base 16, four mesh sides 18, four rail covers 20, and four seamed corners 22 connecting the sides of the mesh sides 18. Alternatively, the crib safety product 14 may be formed without the four seamed corners 22, either with the sides of the mesh sides 18 being left unseamed or being seamed directed to each other. The bumper base 16 is preferably made of a base fabric of cotton/muslin cotton poly or tricot fabric. The mesh sides 18 are preferably made of a mesh fabric with openings about ¼" in size or smaller and with a thickness of up to about ¼". The rail covers 20 are preferably made of a washable decorative padded fabric that folds over the crib railing and is preferably maintained over the railing by snaps, hook-and-loop fasteners (e.g. Velcro® fasteners), or elastic.

Figure 3:
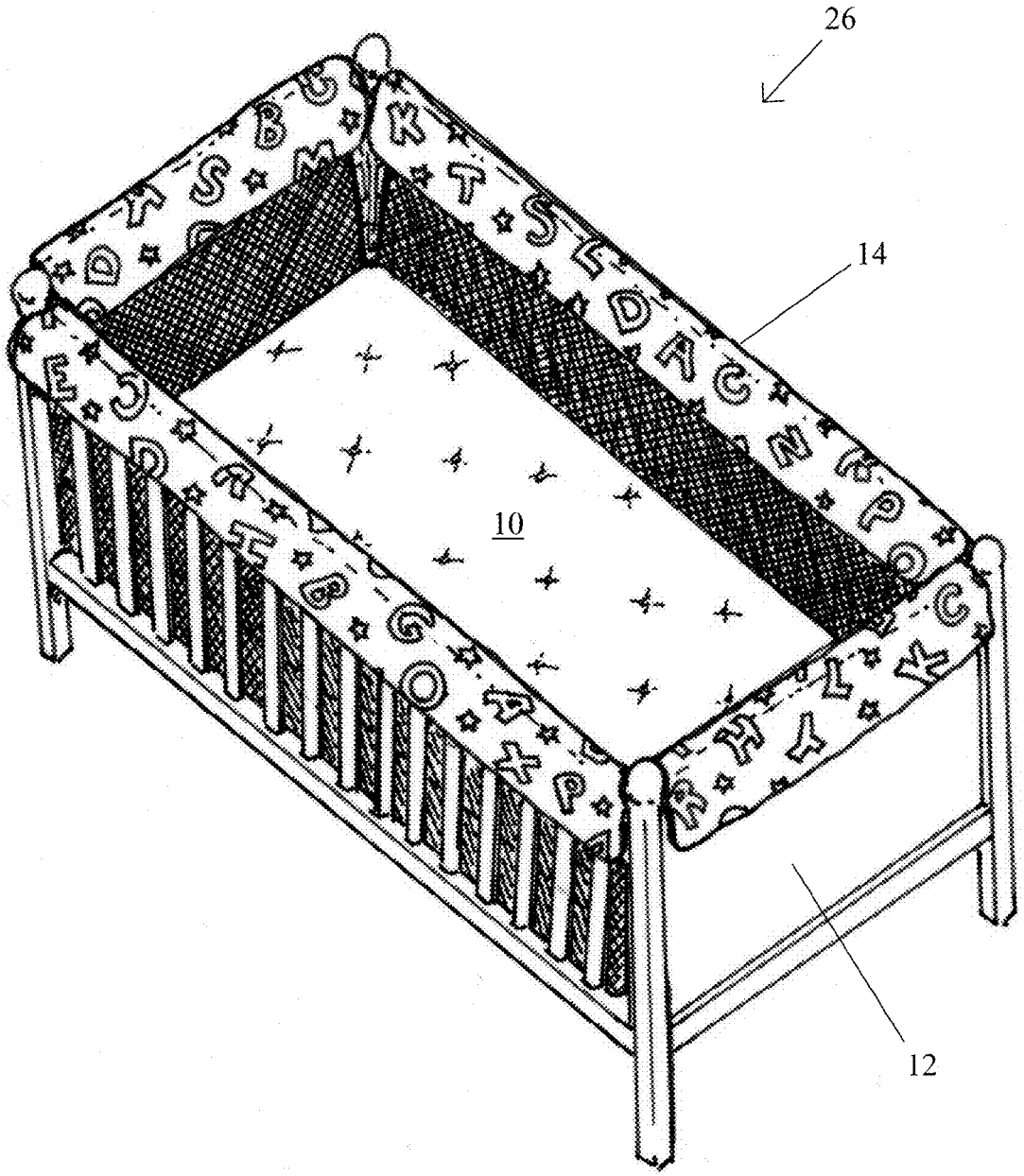
FIG. 3 shows the bumper, mattress, and crib of FIG. 1 after assembly.

FIG. 3 shows the crib assembly 26 with the crib safety product 14 placed in the crib 12 and the mattress 10 placed on top of the bumper base of the crib safety product 14. The rail covers extend over the four rails and are secured in place by the fasteners.

As shown in FIG. 1 and FIG. 2, the entire bumper design is held together by the base. The base is the material that is placed underneath the crib mattress for security. This is important as it helps to tightly secure the entire bumper. The base material is preferably a durable fabric that is strong enough to withstand the pressure from the other materials that are attached. In one preferred embodiment, organic materials such as cotton muslin or bamboo may be used for the base. In other embodiments, the base material may be any durable fabric including, but not limited to, synthetic or sustainable, natural materials including polyester, a cotton/polyester blend, or tricot fabric. The base dimensions are preferably consistent with the standard measurements of a crib mattress which are 51⅝" long and 27¼" wide. The attached mesh sides go up the inside of the crib and extend over the railing. The seams that hold the bumper together inside the crib are preferably made of the same material and design that extends over the railing. This can also be any other material and/or pattern. This creates a box-shaped body and serves to create an enclosed, safe area inside the crib.

In alternative embodiments, other types of attachment mechanisms than sewn seams can be used to attach the mesh sides to each other. For example, hook-and-loop fasteners or ties may be used to attach the sides to each other. In these embodiments, the sides can be detached from each other when not in the crib, thus allowing the crib safety product to be stored flat when not in use.

Figure 6:
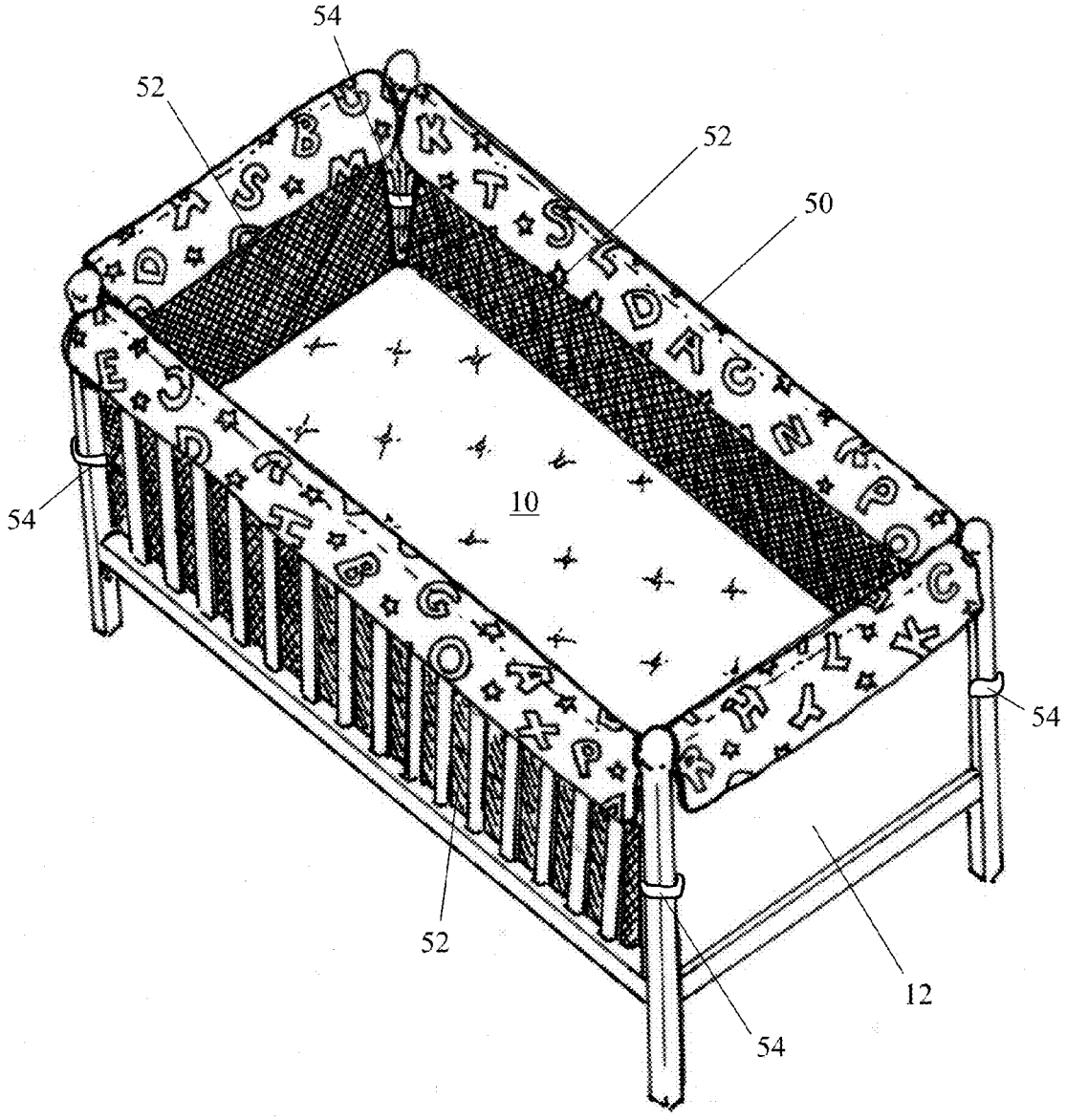
FIG. 6 shows a bumper with fasteners that hold the mesh sides in place in an embodiment of the present invention.

An example of an embodiment where the mesh sides are not attached to each other prior to placing the crib bumper 50 into the crib 12 is shown in FIG. 6. The crib bumper 50 in these embodiments is easy to fold and store when not in use. In this example, the mesh sides 52 are securely fastened to the crib by straps 54 that are attached to the mesh and/or crib rail cover and wrap around the crib rails. The straps may have fasteners including, but not limited to, snaps, buttons, and hook-and-loop fasteners. The straps help keep the mesh in place and prevent a child from putting their hands behind the mesh.

The full size design helps to prevent children from climbing out of their cribs. The sides are a mesh material and/or a material that is see through and allows complete airflow. The mesh-like material is preferably thick and soft enough to provide the ultimate cushion for the child while maintaining a safe, breathable environment. This material can be any color or pattern. The mesh allows for adequate airflow through the crib, and if the child were to fall asleep with his/her face against the mesh, the child can easily breathe through the material. The holes in the mesh are small enough to prevent the child's limbs from getting through but large enough to allow for full view of the child. The material extending over the railing is preferably made of a fabric that provides a safe, chewable surface for teething. This material can be any fabric that is safe, comfortable and preferably machine washable.

The fabric for the teething rail cover is preferably organic or otherwise eco-friendly. In one preferred embodiment, the fabric is bamboo and organic cotton. Other natural or synthetic materials, including but not limited to, polyester, cotton, silk, mesh, wool or sateen, could alternatively be used. The surface of the extended material over the railing can be any color and/or pattern. This helps to protect the crib investment as well as helping to prevent the child from consuming paint chips and/or splinters. The material that extends over the railing is preferably stylish with great colors and/or educational value for example, including letters, shapes, and/or numbers, which are on the inside and/or outside of the crib railing. The material that extends over the railing can be any height and length. The material that extends over the railing can be solid colors or include one or more embellishments.

The material that extends over the railing is preferably filled with a batting material that is safe for a child and will hold up if the child were to chew on the material. The batting can be any material. In a preferred embodiment, the batting is preferably organic cotton or bamboo batting or fill. Alternative types of fill or batting include, but are not limited to, polyester, cotton or wool. In another alternative embodiment, the mesh material could be put inside of the material that extends over the railing.

Teething toys or any other type of child toy accessory can attach to the material extending over the railing with any types of fasteners, including, but not limited to, zippers, buttons, hook-and-loop fasteners, hook-and-eye fasteners, toggles, ties, grommets, stitching, and snaps. A combination of any of these fasteners may be used.

In a preferred embodiment, the material that extends over the railing is fastened to the mesh or other material, with a fastener, including but not limited to, zippers, buttons, hook-and-loop fasteners, hook-and-eye fasteners, toggles, ties, grommets, stitching, snaps or any combination of these fasteners. These fasteners can be of any material and/or design. The material that extends over the railing is easily removed for laundering by unfastening this material from the mesh material. There is no need to remove the whole bumper pad in order to launder the material that extends over the railing. The fasteners are preferably positioned so that they are difficult for a child to access because of where they are positioned and/or by the presence of a pocket zipper or other hidden fasteners. In an alternative embodiment, the material that extends over the railing is permanently attached to the mesh material.

Figure 7:
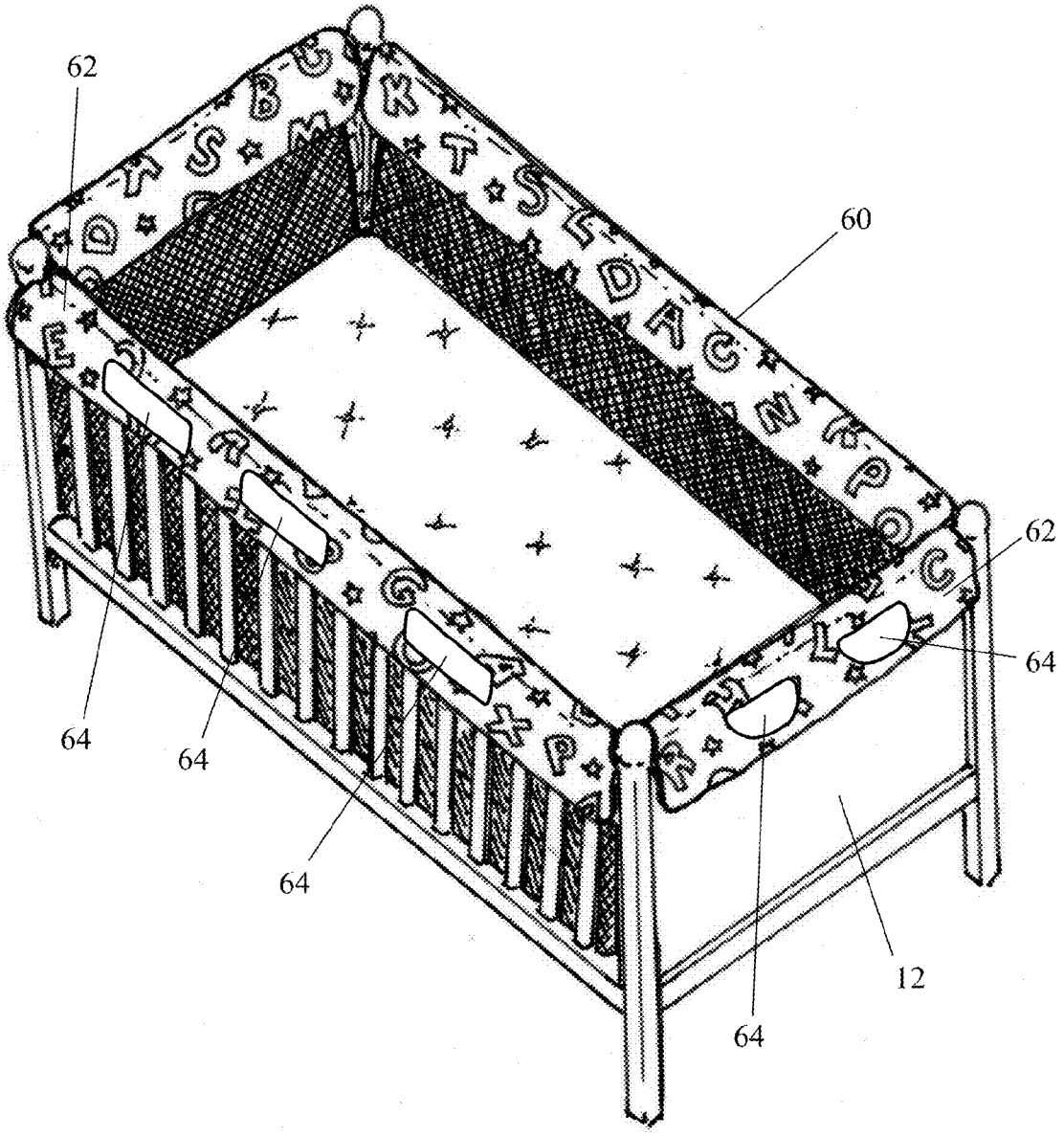
FIG. 7 shows pockets in the teething rail cover of a crib bumper in an embodiment of the present invention.

In another preferred embodiment, the teething rail cover 62 of the crib bumper 60 includes one or more pockets 64, as shown in FIG. 7. The pockets may be permanently attached to the teething rail cover by any method, including, but not limited to sewing or adhesive. Alternatively, the pockets may be reversibly attached to the teething rail cover by any method, including, but not limited to, fastening using zippers, buttons, hook-and-loop fasteners, hook-and-eye fasteners, toggles, ties, grommets, stitching, and snaps. There may be any number of pockets 64, in any size or shape that fits on the teething rail cover 62. Although the pockets 64 are only shown on the external portion of the crib rails in FIG. 7, additionally or alternatively, one or more pockets may be included on the portion of the teething rail cover material that is within the crib. In some embodiments, the pockets include decorative or educational designs. The pockets can hold toys, pacifiers, or any other item that fits into them. Of course, the pockets should only be used to hold items that are safe for the infant to be able to obtain. In some embodiments, the pockets may include fasteners to close the pocket opening as needed.

Due to the different height selections for the mattress, the bumper preferably optionally has fasteners on the base that allow for adjustment in height for the sides of the bumper. The bumper can be adjusted for all heights of the crib mattress or it can be a fixed height. These fasteners may be any fasteners, including but not limited to, zippers, buttons, hook-and-loop fasteners, hook-and-eye fasteners, toggles, ties, grommets, stitching, and snaps. A combination of these fasteners may be used. The height of the crib safety product can also be adjusted by adjusting the material extending over the railing by using any of the above named fasteners. Any combination of these fasteners may be used.

The bumper can also have a skirt attached to the base. This skirt would take the place of a crib skirt. The skirt would preferably match the material extending over the railing. It could also be another color and/or pattern.

In a preferred embodiment, at least one of the base material, the mesh-like material, the material going over the rail, and the optional bed skirt material are made of organic materials. If any of the materials are dyed, they are preferably dyed with non-toxic, low-impact dyes that do not contain the allergic heavy metals and toxic chemicals that can cause allergic reactions.

Different designs for the crib safety product described herein can be used to accommodate the different cribs on the market. In all of these designs, mesh-like material and material that extends over the railing are preferably included on each of the sides of the crib that have slats or other openings that could otherwise be dangerous to the child occupying the crib. In preferred embodiments, the mesh and extending material are only included on the sides of the crib that have slats or other openings and are not located on the sides or ends that are solid. However, other designs that also include the mesh and/or the extending material on solid sides or ends of the crib are also contemplated.

Figure 4:
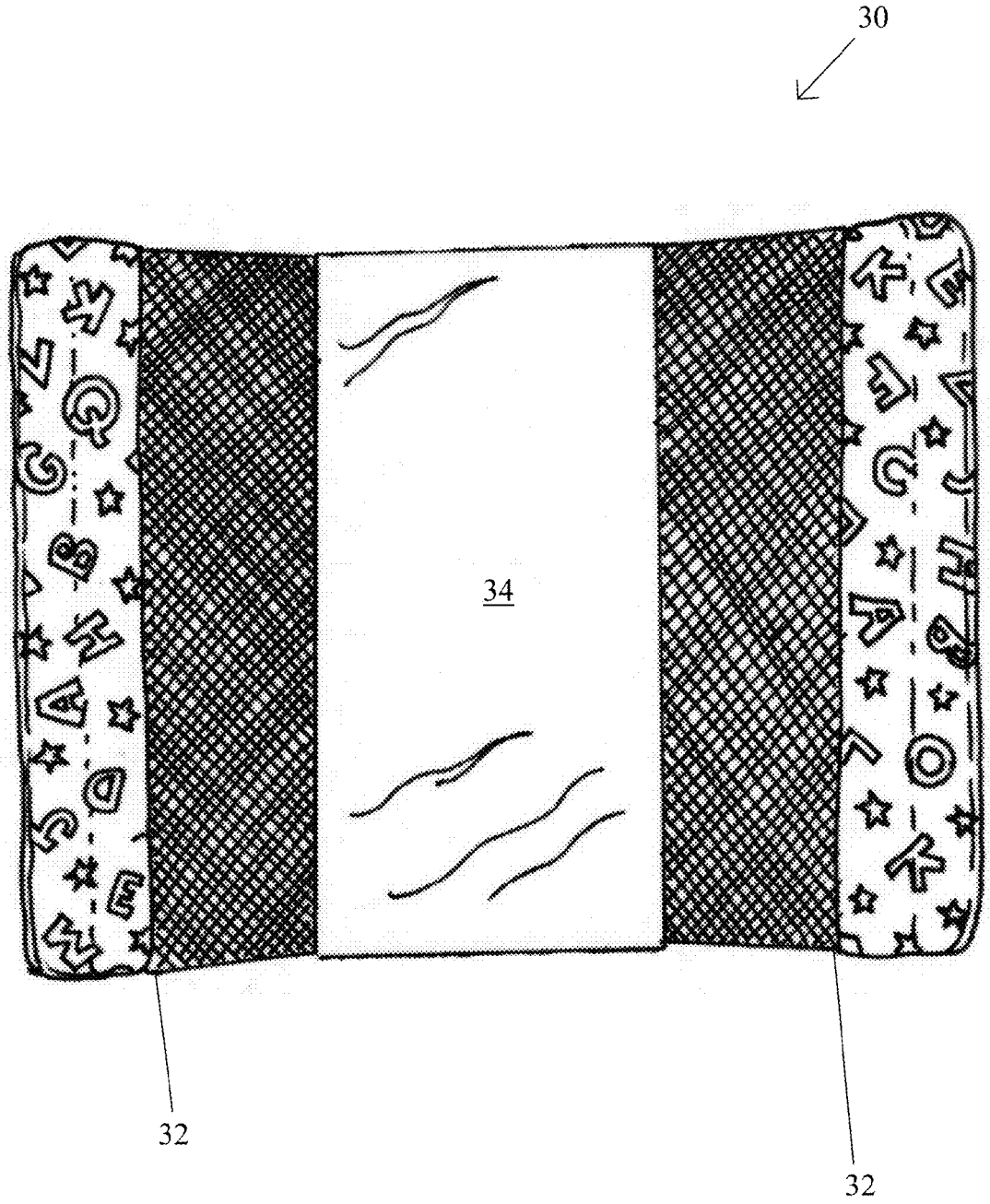
FIG. 4 shows a bumper that can be used on a solid end crib in an embodiment of the present invention.
Figure 5:
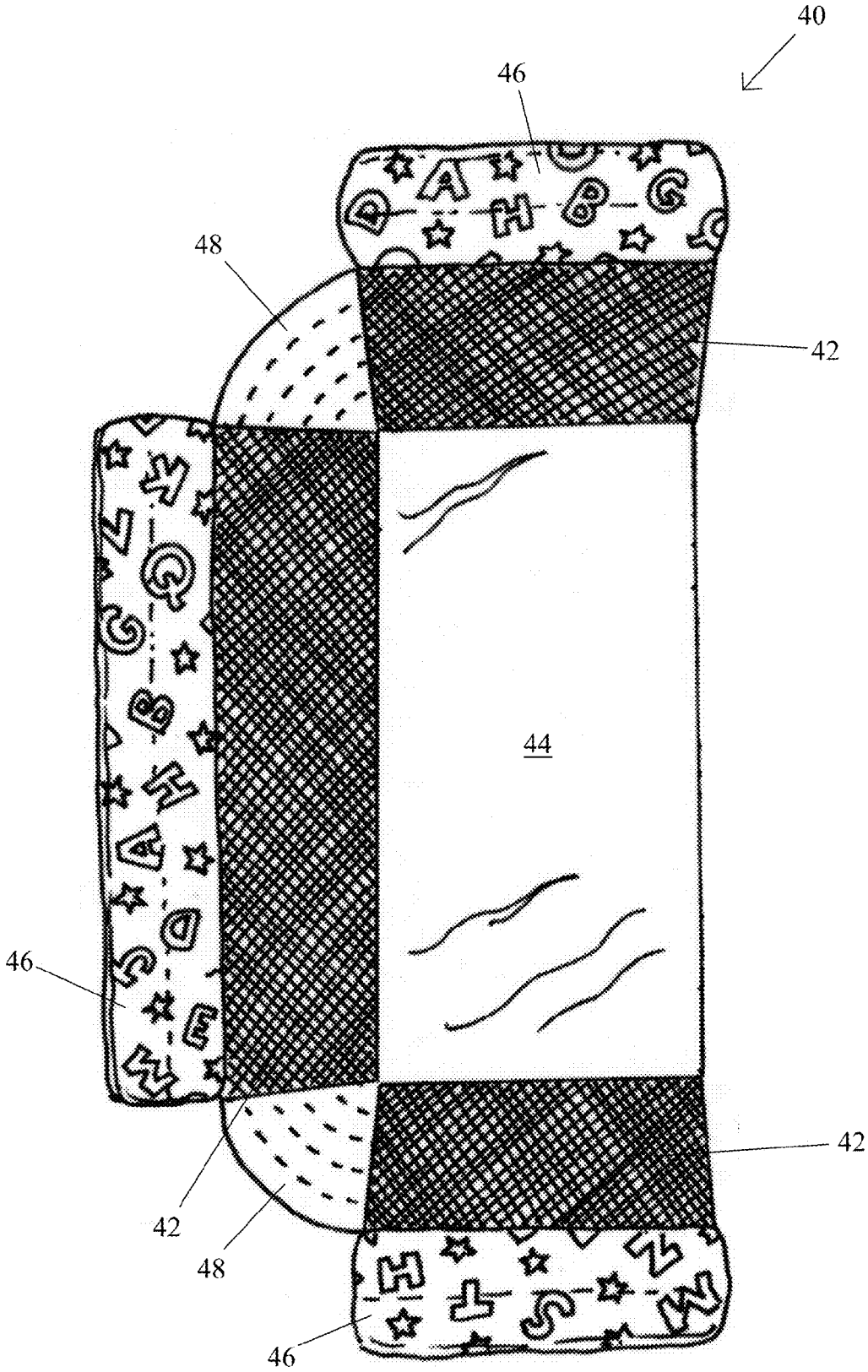
FIG. 5 shows a bumper that can be used on a solid back crib in an embodiment of the present invention.

One design for the crib safety product is for slatted cribs that have slats on all four sides of the crib. Examples of this design are shown in FIG. 1 and FIG. 2. An alternative design 30 for solid end cribs that only have slats in the front and back of the crib is shown in FIG. 4. In this design, the two sides 32 of the crib bumper 30 extending from the base 34 and extending over the railing are placed over the front and back of the crib. The design shown in FIG. 1 and FIG. 2 could also be used with a solid end crib. Other alternative designs can be used for solid back cribs that have slats on the front and two sides of the crib. One example of this design, shown in FIG. 5, is a crib bumper 40 with three mesh sides 42 extending from the bumper base 44 and three rail covers 46 that extend over the railing on the three sides of the crib with the slats. The crib bumper 40 also has two seamed corners 48 between side edges of the mesh sides 42. Although seamed corners 48 are shown in FIG. 5, designs may alternatively have no seamed corners within the spirit of the present invention. Another example, shown in FIG. 3, has mesh material and the extending material on all four sides, even on the back side of the crib that is solid.

Figure 8:
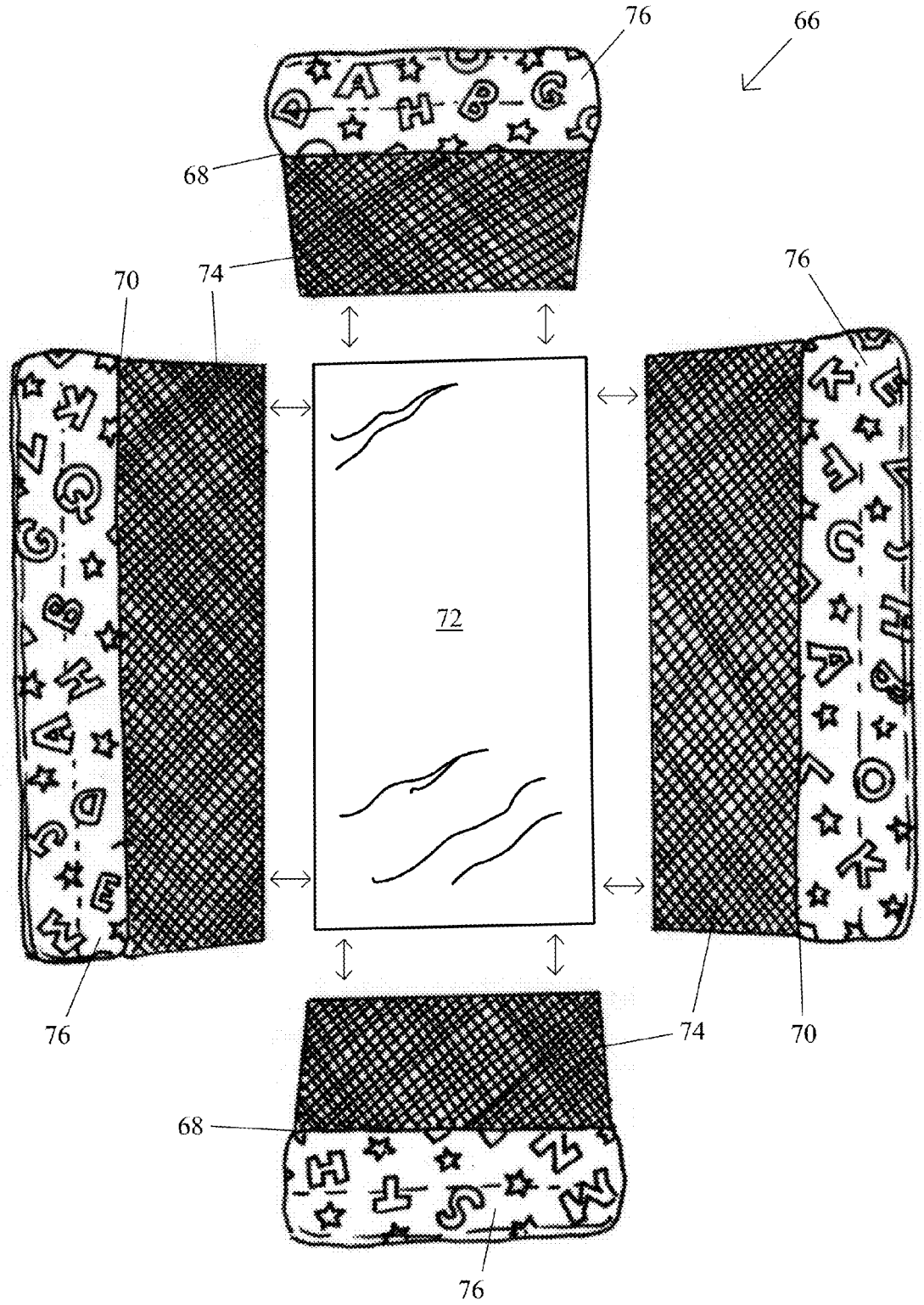
FIG. 8 shows a bumper with removable mesh sides in an embodiment of the present invention.

FIG. 8 shows an embodiment of the crib bumper 66 where the sides 68, 70 are detachable from the bumper base 72. Unlike the embodiments shown in FIG. 1 through FIG. 5, where the mesh sides are permanently attached to the base, in this embodiment, the side mesh material 74 may be releasably attached to the base with fasteners. Examples of fasteners that could be used include, but are not limited to, snaps, hook-and-loop fasteners, toggles, ties, grommets, hook-and-eye fasteners, buttons, and zippers. Any combination of these fasteners may be used. In preferred embodiments, the mesh sides can be fastened together, for example in a manner shown in FIG. 6.

Figure 11:
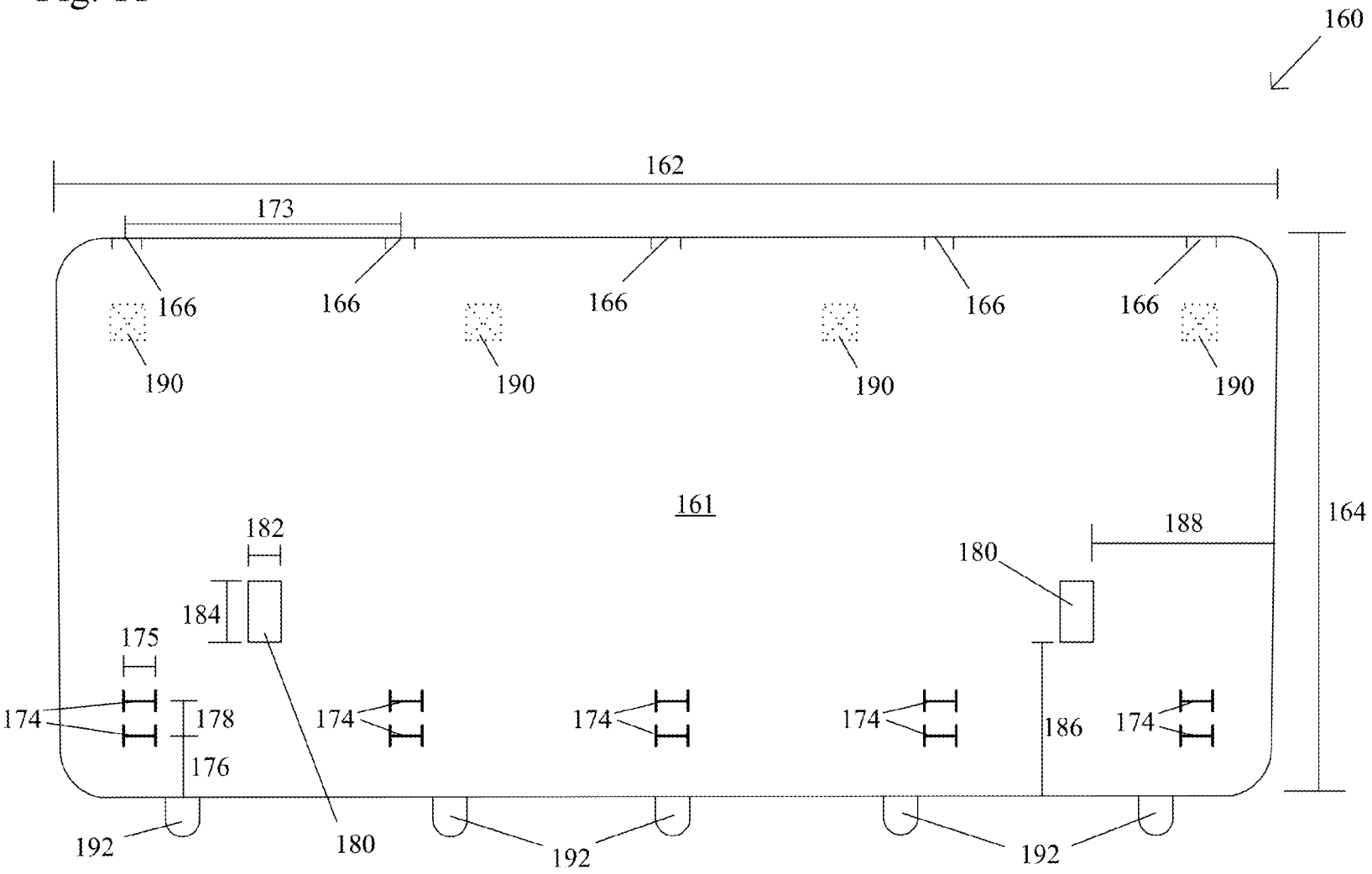
FIG. 11 shows the front side of a long rail cover in an embodiment of the present invention.

In the embodiment shown in FIG. 8, the crib bumper 66 can accommodate all types of cribs, because the end user can choose to attach from one to four mesh sides 74 onto the base. For example, if the ends of the cribs are solid, the mesh sides 74 that cover only the sides of the crib could be added to the bumper base 72. In another example, where both sides and one end include slats, the mesh sides could be attached to the base only on the three sides with slats. In preferred embodiments, the mesh sides 74 are detachable from the bumper base 72 and the teething rail cover 76 is detachable from the mesh sides 74 (as described above). FIG. 11 shows a detachable teething rail cover design 160.

Crib Rail Cover

In some embodiments, the crib teething rail cover may be detachable from the other parts of the one-piece bumper design embodiment. In other embodiments, the crib teething rail cover may be an independent device. The crib rail cover includes at least one fastener strap including a pair of fastener strips fastened to and extending from the back side of the crib rail cover base. In some embodiments, the crib rail cover also includes at least one tie strap including a pair of tie strips fastened to and extending from the top edge of the crib rail cover base, and the crib rail cover base has at least one pair of openings through the crib rail cover base sized and located to receive the tie strips. In other embodiments, the crib rail cover includes at least one loop extending from the back side of the crib rail cover base, and the loop is sized and located to receive the fastener strap. The crib rail cover is placed over a rail of the crib and is fastened to the rail using the straps.

In some embodiments, the crib rail cover is a stand-alone piece that is mounted over the rail on one or more sides of the crib without a mesh side and without a bumper base. Although the rail cover designs of FIG. 9A through FIG. 14B are shown as stand-alone crib rail cover pieces, alternatively, any of these designs may be permanently or detachably attached to a mesh side and used as the rail cover in any of the embodiments of FIG. 1 through FIG. 8.

Figure 9A:
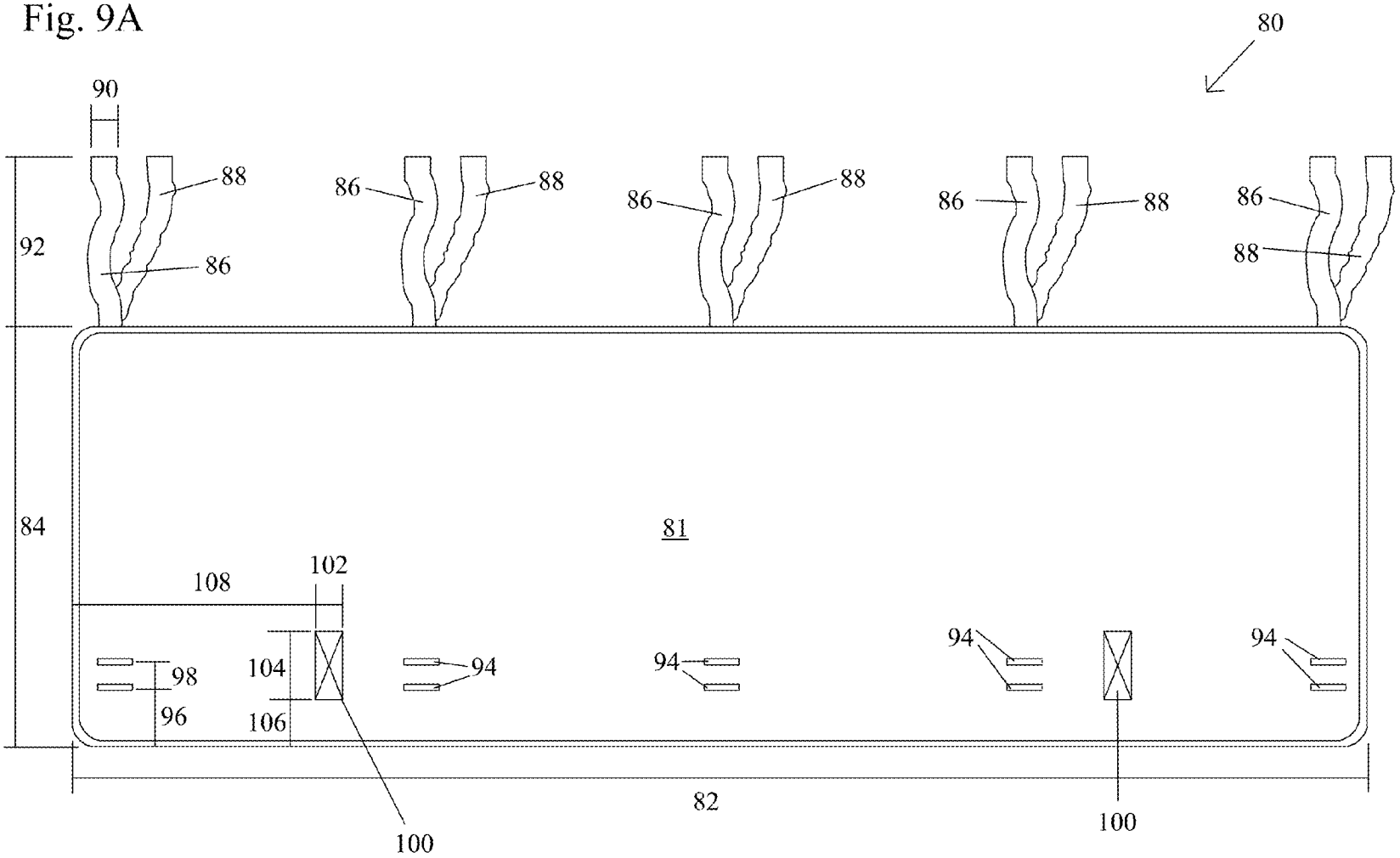
FIG. 9A shows the front side of a long rail cover in an embodiment of the present invention.
Figure 12:
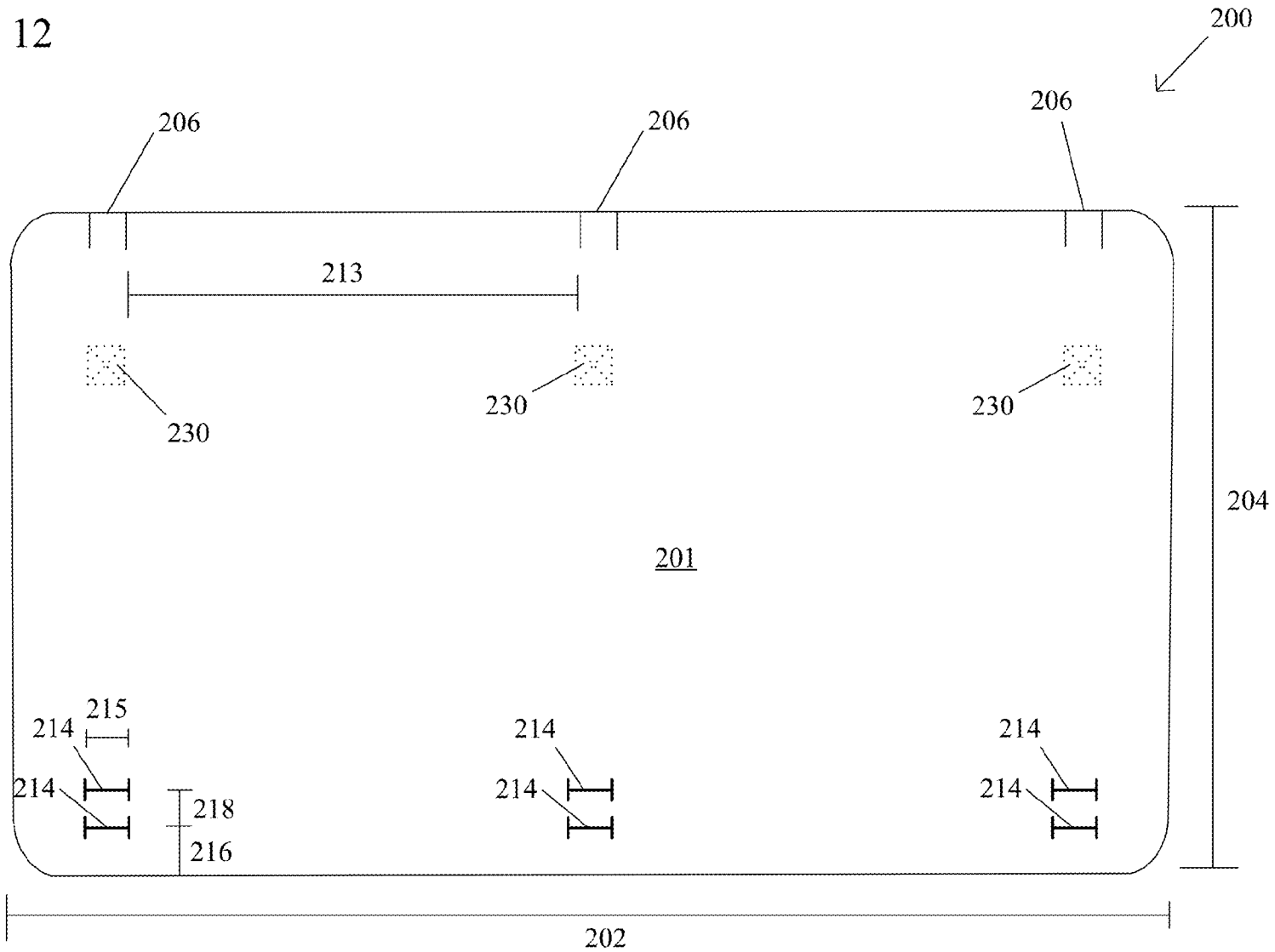
FIG. 12 shows the front side of a short rail cover in an embodiment of the present invention.

FIG. 9A through FIG. 12 show teething rail cover designs where the part of the cover that is on the inside of the crib extends farther down than the part of the cover that is on the outside of the crib when the rail cover is attached to a crib rail. There are slits preferably sewn about 2" up from the bottom of the outside part of the cover. Ties sewn at the inside bottom of the cover on the inside part extend through the slits to maintain the rail cover on the crib rail. When the ties go through the slits, the inside of the rail cover is forced to shift upward. This helps to prevent a child from rolling over into the fabric and possibly suffocating. FIG. 9A, FIG. 9B, and FIG. 11 show designs for long rail covers. FIG. 10A, FIG. 10B, and FIG. 12 show designs for short rail covers.

The fabric for the teething rail cover is preferably organic or otherwise eco-friendly. In one preferred embodiment, the fabric is bamboo and organic cotton. Other natural or synthetic materials, including but not limited to, polyester, cotton, silk, mesh, wool or sateen, could alternatively be used. The surface of the extended material over the railing can be any color and/or pattern. This helps to protect the crib investment as well as helping to prevent the child from consuming paint chips and/or splinters. The material that extends over the railing is preferably stylish with great colors and/or educational value for example, including letters, shapes, and/or numbers, which are on the inside and/or outside of the crib railing. The material that extends over the railing can be any height and length. The material that extends over the railing can be solid colors or include one or more embellishments.

Figure 9B:
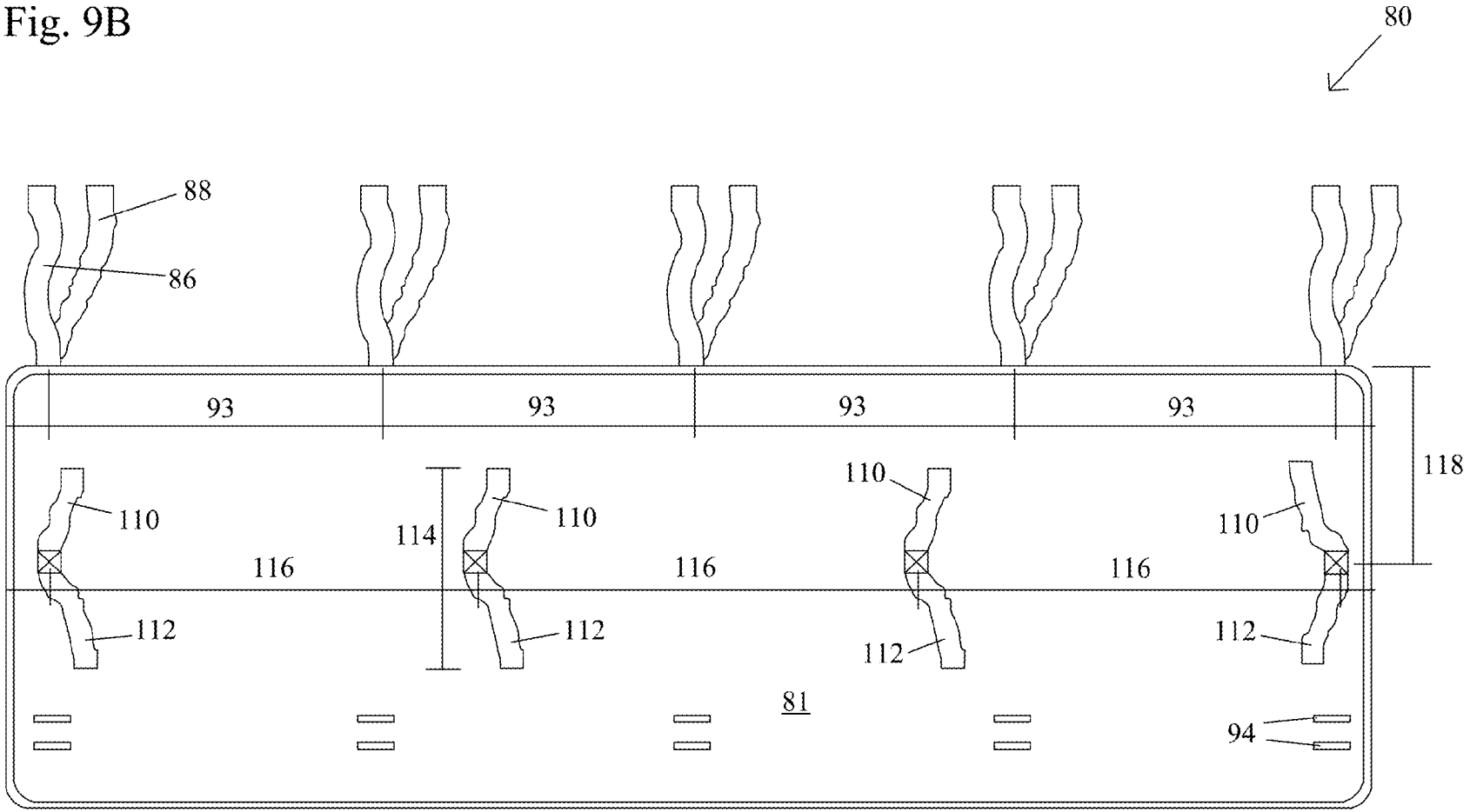
FIG. 9B shows the back side of the long rail cover of FIG. 9A.

The long rail cover 80 of FIG. 9A and FIG. 9B has a substantially rectangular shaped rail cover base 81 with a length 82 and a width 84 and with slightly rounded corners. Five pairs of tie straps 86, 88 with a width 90 and a length 92 are spaced an even distance 93 from each other across and extending from the top edge of the base 81. Five corresponding pairs of slits 94 are spaced a distance 96 from the bottom edge of the base 81 and a distance 98 from each other in line with the tie straps 86, 88. Two fastener pads 100 having a width 102 and a length 104 are located on the front side of the rail cover base 81. The fastener pads 100 are located a distance 106 from the bottom of the base 81 and a distance 108 from the sides of the base 81. The fastener pads are preferably hook fastener pads for receiving complementary loop fastener pads but alternatively may be loop fastener pads for receiving complementary hook fastener pads. Other fasteners, including, but not limited to, snaps and buttons, may alternatively be used for the fastener pads 100. Four pairs of fastener strips 110, 112 having a length 114 are attached and spaced preferably an even distance 116 from each other across the back side of the rail cover base 81. The fastener strips 110, 112 are attached a distance 118 from the top of the rail cover base 81. In a preferred embodiment, the length 82, the width 84, the width 90, the length 92, the distance 93, the distance 96, the distance 98, the width 102, the length 104, the distance 106, the distance 108, the length 114, the distance 116, and the distance 118 are 50 inches, 12 inches, one inch, seven inches, 11¾ inches, two inches, ¾ inches, one inch, 1¾ inches, 1½ inches, 8½ inches, nine inches, 15½ inches, and five inches, respectively.

In a preferred method of assembly, the long rail cover 80 is placed on the long rail of a crib with the tie straps 86, 88 outside of the crib and the fastener strips 110, 112 facing downward and aligned with the top rail of the crib. Each pair of fastener strips 110, 112 is wrapped around the top rail and fastened under the rail to form a loop. Each tie strap 86, 88 is inserted through a gap between two of the vertical slats of the long rail and into its respective slit 94 and the ends of each pair of tie straps 86, 88 are tied to each other. Crib toys having a complementary hook-and-loop fastener strip may optionally be attached to one or more of the fastener pads 100, which are on the inward side of the assembled long rail cover 80 facing the inside of the crib.

Figure 10A:
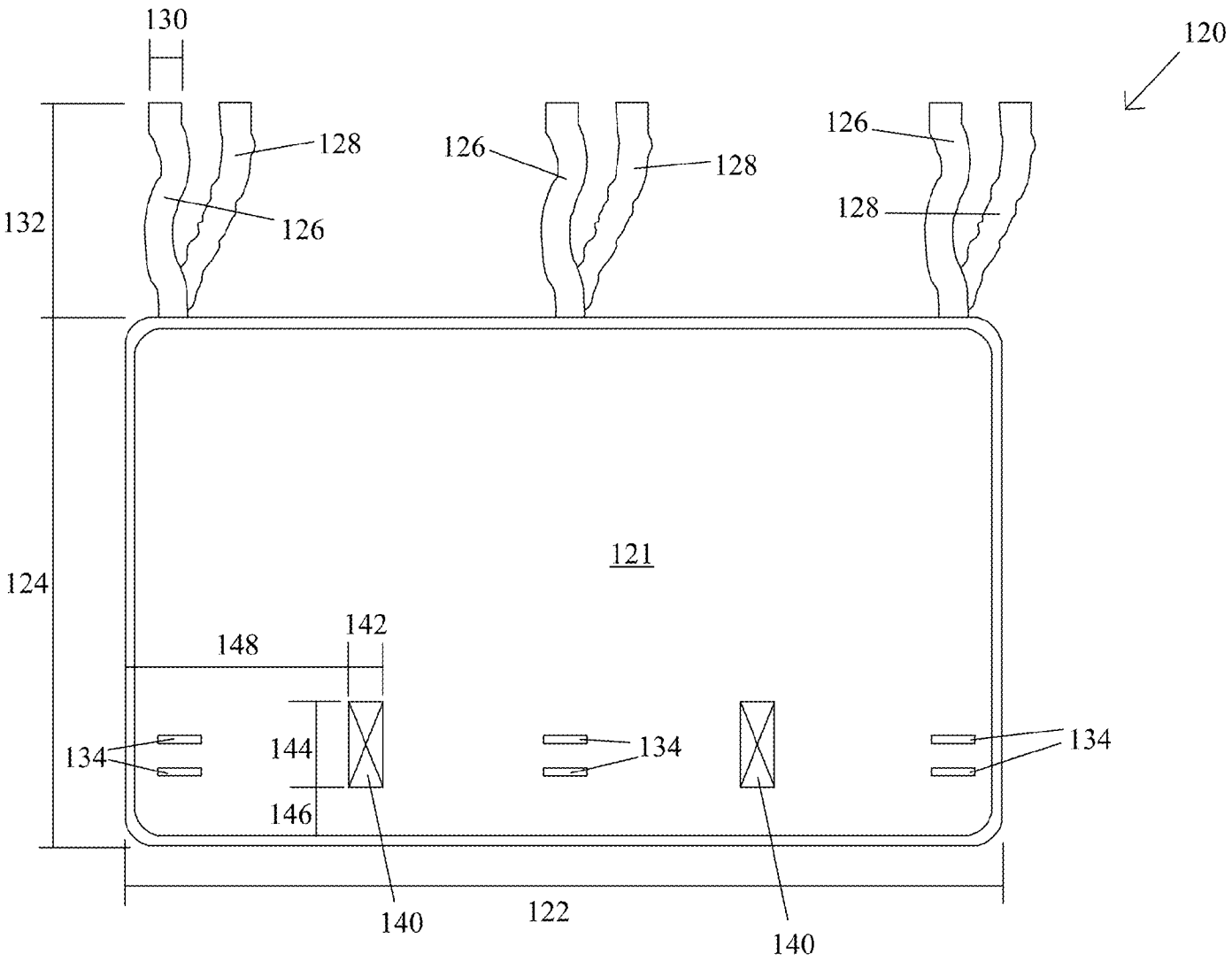
FIG. 10A shows the front side of a short rail cover in an embodiment of the present invention.
Figure 10B:
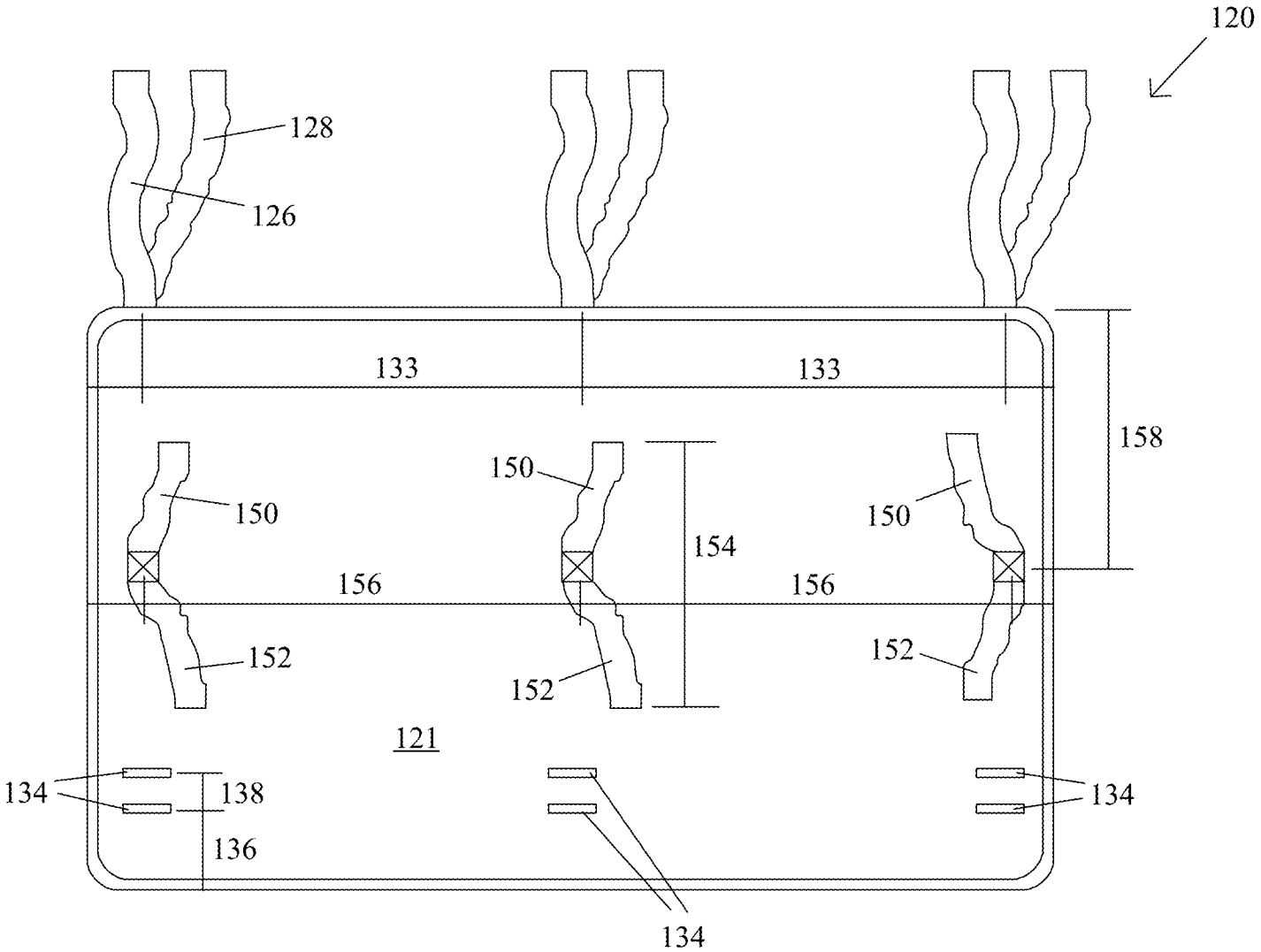
FIG. 10B shows the back side of the short rail cover of FIG. 10A.

The short rail cover 120 of FIG. 10A and FIG. 10B has a substantially rectangular shaped rail cover base 121 with a length 122 and a width 124 and with slightly rounded corners. Three pairs of tie straps 126, 128 with a width 130 and a length 132 are preferably spaced an even distance 133 from each other across and extending from the top edge of the base 121. Three corresponding pairs of slits 134 are spaced a distance 136 from the bottom edge of the base 121 and a distance 138 from each other in line with the tie straps 126, 128. Two fastener pads 140 having a width 142 and a length 144 are located on the front side of the rail cover base 121. The fastener pads 140 are located a distance 146 from the bottom of the base 81 and a distance 148 from the sides of the base 121. The fastener pads are preferably hook fastener pads for receiving complementary loop fastener pads but alternatively may be loop fastener pads for receiving complementary hook fastener pads. Three pairs of fastener strips 150, 152 having a length 154 are attached and spaced an even distance 156 from each other across the back side of the rail cover base 121. The fastener strips 150, 152 are attached a distance 158 from the top of the rail cover base 121. In a preferred embodiment, the length 122, the width 124, the width 130, the length 132, the distance 133, the distance 136, the distance 138, the width 142, the length 144, the distance 146, the distance 148, the length 154, the distance 156, and the distance 158 are 27 inches, 12 inches, one inch, seven inches, 12 inches, two inches, ¾ inches, one inch, 1¾ inches, 1½ inches, seven inches, nine inches, 11¾ inches, and five inches, respectively.

In a preferred method of assembly, the short rail cover 120 is placed on the short rail of a crib with the tie straps 126, 128 outside of the crib and the fastener strips 150, 152 facing downward and aligned with the top rail of the crib. Each pair of fastener strips 150, 152 is wrapped around the top rail and fastened under the rail to form a loop. Each tie strap 126, 128 is inserted through a gap between two of the vertical slats of the short rail and into its respective slit 134 and the ends of each pair of tie straps 126, 128 are tied to each other. Crib toys having a complementary hook-and-loop fastener strip may optionally be attached to one or more of the fastener pads 140, which are on the inward side of the assembled short rail cover 120 facing the inside of the crib.

The long rail cover 160 of FIG. 11 has a substantially rectangular shaped rail cover base 161 with a length 162 and a width 164 and with slightly rounded corners. Five pairs of tie straps (not shown) are spaced an even distance 173 from each other across and extending from the top edge of the base 161 at the indicated locations 166. In a preferred embodiment, the tie straps are eight inches long and one inch wide. Five corresponding pairs of slits 174 having a length 175 are spaced a distance 176 from the bottom edge of the base 161 and a distance 178 from each other in line with the tie straps. Two fastener pads 180 having a width 182 and a length 184 are located on the front side of the rail cover base 161. The fastener pads 180 are located a distance 186 from the bottom of the base 161 and a distance 188 from the sides of the base 161. The fastener pads are preferably hook fastener pads for receiving complementary loop fastener pads but alternatively may be loop fastener pads for receiving complementary hook fastener pads. Four pairs of fastener strips (not shown) are attached at the indicated locations 190 and spaced an even distance from each other across the back side of the rail cover base 161. In a preferred embodiment, the fastener strips are eight inches long and one inch wide. In a preferred embodiment, the length 162, the width 164, the distance 173, the length 175, the distance 176, the distance 178, the width 182, the length 184, the distance 186, and the distance 188 are 51 inches, 18 inches, 12 inches, one inch, two inches, ½ inch, one inch, 1¾ inches, 3½ inches, and 8½ inches, respectively.

The rail cover 160 also optionally includes mesh fasteners 192 located at or near the bottom edge of the rail cover base 161 to allow the rail cover to be reversible attached to the mesh material shown in the embodiments of FIG. 1 through FIG. 8 Any fasteners, including, but not limited to, zippers, buttons, hook-and-loop fasteners, hook-and-eye fasteners, toggles, ties, grommets, stitching, snaps or any combination of these fasteners, may be used within the spirit of the present invention. These fasteners can be of any material or design. This allow the rail cover 160 to be easily removed for laundering by unfastening the rail cover from the mesh material without removing the mesh material or the crib mattress in order to remove the bumper base. There is no need to remove the whole bumper pad in order to launder the material that extends over the railing. The fasteners are preferably positioned so that they are difficult for a child to access because of where they are positioned and/or by the presence of a pocket zipper or other hidden fasteners. Although mesh fasteners 192 are only shown in FIG. 11, mesh fasteners may be included in any of the other illustrated embodiments.

In a preferred method of assembly, the long rail cover 160 is placed on the long rail of a crib with the tie straps extending from locations 166 outside of the crib and the fastener strips extending from locations 190 facing downward and aligned with the top rail of the crib. Each pair of fastener strips is wrapped around the top rail and fastened under the rail to form a loop. Each tie strap is inserted through a gap between two of the vertical slats of the long rail and into its respective slit 174 and the ends of each pair of tie straps are tied to each other. Crib toys having a complementary hook-and-loop fastener strip may optionally be attached to one or more of the fastener pads 190, which are on the inward side of the assembled long rail cover 160 facing the inside of the crib.

The short rail cover 200 of FIG. 12 has a substantially rectangular shaped rail cover base 201 with a length 202 and a width 204 and with slightly rounded corners. Three pairs of tie straps (not shown) are spaced an even distance 213 from each other across and extending from the top edge of the base 201 at the indicated locations 206. In a preferred embodiment, the tie straps are eight inches long and one inch wide. Three corresponding pairs of slits 214 having a length 215 are spaced a distance 216 from the bottom edge of the base 201 and a distance 218 from each other in line with the tie straps. Three pairs of fastener strips (not shown) are attached at the indicated locations 230 and spaced an even distance from each other across the back side of the rail cover base 201. In a preferred embodiment, the fastener strips are eight inches long and one inch wide. In a preferred embodiment, the length 202, the width 204, the distance 213, the length 215, the distance 216, and the distance 218 are 27 inches, 18 inches, 10⅝ inches, one inch, two inches, and ½ inch, respectively. Although the design of FIG. 12 does not include fastener pads, fastener pads similar to the fastener pads shown in the previous embodiments may alternatively be included in such a design.

In a preferred method of assembly, the short rail cover 200 is placed on the short rail of a crib with the tie straps extending from locations 206 outside of the crib and the fastener straps extending from locations 230 facing downward and aligned with the top rail of the crib. Each pair of fastener strips is wrapped around the top rail and fastened under the rail to form a loop. Each tie strap is inserted through a gap between two of the vertical slats of the short rail and into its respective slit 214 and the ends of each pair of tie straps are tied to each other.

In some embodiments, a fastening system for a rail cover includes hook-and-loop fastener strips and plastic rings or loops. Preferably, an extra fastener strip runs the entire length of the rail cover to help make the rail cover tauter. Since the rail cover base extends the same distance over both sides of the crib rail in these embodiments, the rail cover base may be oriented with either side being on the inside of the crib and either side being on the outside of the crib, although the side with the plastic rings or loops is preferably on the inside of the crib. This fastening system is a safer way to attach a teething rail cover. One-inch hook-and-loop fastener squares on the front of the teething rail cover permit objects to be attached to the cover. In some embodiments, the objects are decorative.

In other embodiments, the objects are baby toys. In yet other embodiments, the objects are storage units, including but not limited to, pockets.

FIG. 13A and FIG. 13B show a fastening system for a long rail cover 240. The long rail cover 240 has a substantially rectangular shaped rail cover base 242. Five hook-and-loop fastener straps 244 are spaced an even distance from each other across the base 242. Each fastener strap 244 includes a fabric backing square 246, a hook fastener strip 248, and a loop fastener strip 250. Alternatively, the hook fastener strip and the loop fastener strip may be switched. In a preferred embodiment, the fabric backing square is 1½ inches by 1½ inches. Five corresponding loops 252 are locate on the other half of the rail cover base 242 in line with the fastener straps 244. In a preferred embodiment, the loops 252 are one-inch white plastic loops. One or both of the strips 248, 250 is inserted through its respective loop 252 and the strips 248, 250 are fastened to each other to maintain the rail cover on the crib rail. Two strips of loop fasteners 254 are located on the side edges of the back side of the rail cover base 242. Alternatively, the strips 254 may be hook fasteners. These strips 254 attach to the other side of the crib rail cover base 242 to prevent the baby from sliding the crib rail cover over. The top of the crib rail is aligned between the dashed lines 256, 258, when the rail cover 240 is properly mounted to the crib rail. A pair of fastener strips 257, 259 runs the length of the rail cover base 242 near the top and bottom edge to help make the rail cover tauter. The pair 257, 259 preferably includes one strip of hook fasteners and one strip of loop fasteners. Either type of fastener may be on either side of the crib rail cover base 242.

In a preferred method of assembly, the long rail cover 240 is placed on the long rail of a crib with the dashed lines 256, 258 facing downward and aligned with the top rail of the crib. One of each pair of fastener strips 248, 250 is inserted through a gap between two of the vertical slats of the long rail and through its respective loop 252 and the ends of each pair of fastener strips 248, 250 are attached to each other to form a loop with the fastener strap 244. Either or both of the strips 248, 250 may be inserted through the loop 252 within the spirit of the present invention. The pair of hook and loop fasteners 257, 259 are attached to each other to provide further security and stabilization.

Figure 14A:
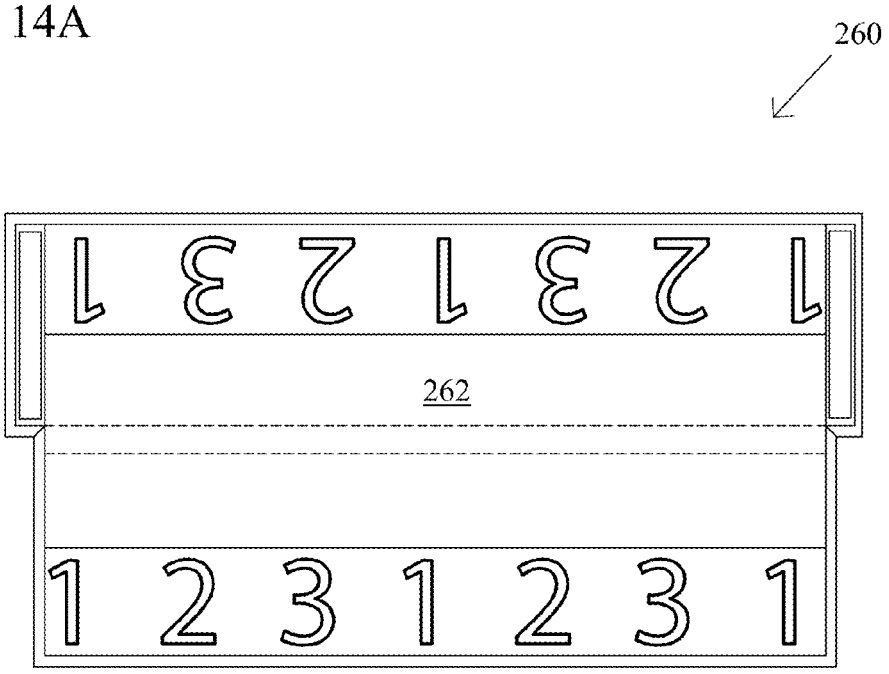
FIG. 14A shows the front side of a short rail cover in an embodiment of the present invention.
Figure 14B:
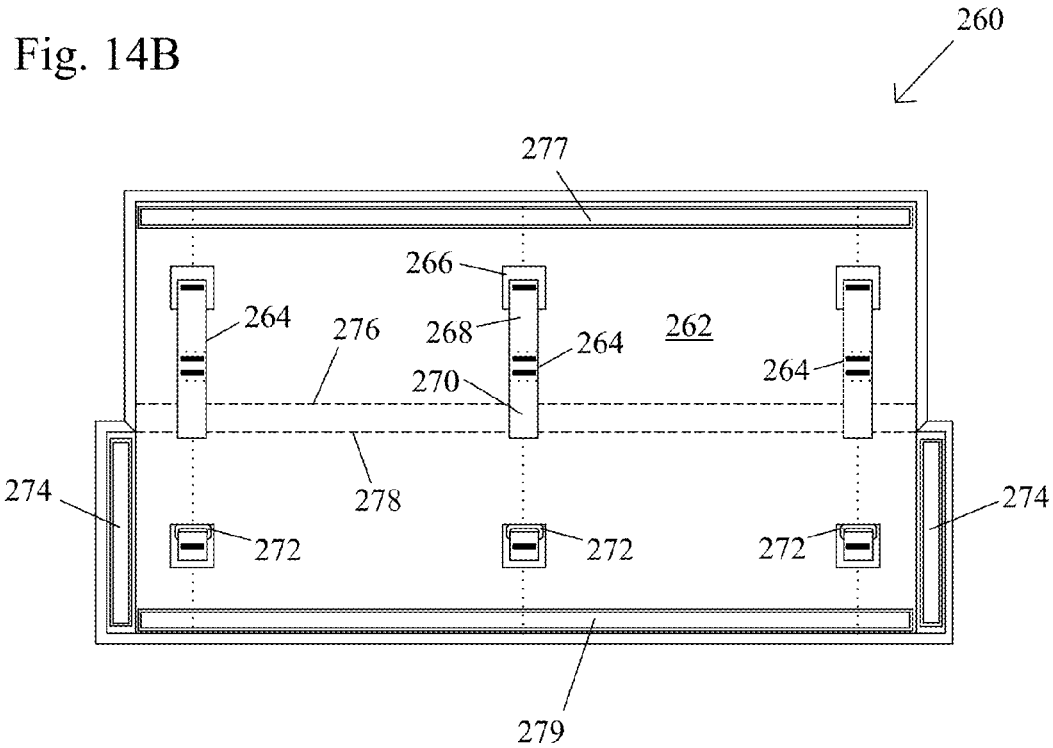
FIG. 14B shows the back side of the short rail cover of FIG. 14A.

FIG. 14A and FIG. 14B show a fastening system for a short rail cover 260. The short rail cover 260 has a substantially rectangular shaped rail cover base 262. Three hook-and-loop fastener straps 264 are spaced an even distance from each other across the base 262. Each fastener strap 264 includes a fabric backing square 266, a hook fastener strip 268, and a loop fastener strip 270. In a preferred embodiment, the fabric backing square is 1½ inches by 1½ inches. Five corresponding loops 272 are located on the other half of the rail cover base 262 in line with the fastener straps 264. In a preferred embodiment, the loops 272 are one-inch white plastic loops. One or both of the strips 268, 270 is inserted through its respective loop 272 and the strips 268, 270 are fastened to each other to maintain the rail cover on the crib rail. Two strips of loop fasteners 274 are located on the side edges of the back side of the rail cover base 262. Alternatively, the strips 274 may be hook fasteners. These strips 274 attach to the other side of the crib rail cover base 262 to prevent the baby from sliding the crib rail cover over. The top of the crib rail is aligned between the dashed lines 276, 278, when the rail cover 260 is properly mounted to the crib rail. A pair of fastener strips 277, 279 runs the length of the rail cover base 262 near the top and bottom edge to help make the rail cover tauter. The pair 277, 279 preferably includes one strip of hook fasteners and one strip of loop fasteners. Either type of fastener may be on either side of the crib rail cover base 262.

In a preferred method of assembly, the short rail cover 260 is placed on the short rail of a crib with the dashed lines 276, 278 facing downward and aligned with the top rail of the crib. One of each pair of fastener strips 268, 270 is inserted through a gap between two of the vertical slats of the short rail and through its respective loop 272 and the ends of each pair of fastener strips 268, 270 are attached to each other to form a loop with the fastener strap 264. Either or both of the strips 268, 270 may be inserted through the loop 272 within the spirit of the present invention. The pair of hook and loop fasteners 277, 279 are attached to each other to provide further security and stabilization.

Although particular numbers of tie straps, slits, fastener straps, and fastener pads are shown, any number of such items may be used within the spirit of the present invention. Although the spacings of the tie straps, slits, and fastener straps are shown as being even, uneven spacings may also be used within the spirit of the present invention.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A crib safety product comprising:

a crib rail cover base having a front side, a back side opposite the front side, a top edge, a bottom edge opposite the top edge, and a pair of opposing side edges;

at least one fastener strap comprising a pair of fastener strips fastened to and extending from the back side of the crib rail cover base; and at least one tie strap comprising a pair of tie strips fastened to and extending from the top edge of the crib rail cover base, the crib rail cover base having at least one opening through the crib rail cover base sized and located a first distance from the bottom edge to receive the tie strips;

wherein the crib rail cover base is sized to cover a top rail of a crib.

2. The crib safety product of claim 1 further comprising at least one fastener pad attached to the front side of the crib rail cover base.

3. The crib safety product of claim 1, wherein the fastener strap is a hook-and-loop fastener.

4. The crib safety product of claim 1 further comprising a mesh side attached to and extending from the bottom edge of the crib rail cover base, wherein the mesh side is sized to fit a crib wall rail.

5. The crib safety product of claim 4 further comprising at least one mesh fastener attached to the crib rail cover base such that the crib rail cover base is detachable from the mesh side.

6. The crib safety product of claim 4 further comprising a bumper base attached to and extending from the mesh side, wherein the bumper base is sized to fit under a crib mattress in the crib.

7. The crib safety product of claim 1, wherein the at least one fastener strap extends from an upper portion of the back side of the crib rail cover base such that the top edge of the crib rail cover base is lower than the bottom edge of the crib rail cover base when the fastener strap is fastened around the top rail of the crib.

8. A method of assembly of a crib safety product, comprising a crib rail cover base having a front side, a back side opposite the front side, a top edge, a bottom edge opposite the top edge, and a pair of opposing side edges, at least one fastener strap comprising a pair of fastener strips fastened to and extending from the back side of the crib rail cover base, and at least one tie strap comprising a pair of tie strips fastened to and extending from the top edge of the crib rail cover base, the crib rail cover base having at least one opening through the crib rail cover base sized and located a first distance from the bottom edge to receive the tie strips, to a crib rail of a crib, the method comprising the steps of:

a) placing the crib rail cover base on a top rail of the crib rail with the back side facing the top rail and the top edge outside the crib;

b) wrapping the fastener strap around the top rail and fastening each pair of fastener strips to each other to form a loop; and c) inserting each tie strip through its corresponding opening and tying the pair of tie strips together such that the bottom edge of the crib rail cover base is shifted upward with respect to the crib rail, thereby preventing a child from rolling over into the crib safety product and suffocating.

9. The method of claim 8, wherein each pair of fastener strips is a hook fastener strip and a loop fastener strip and in step b) the hook fastener strip is fastened to the loop fastener strip of each fastener strap to form the loop.

10. The method of claim 8 further comprising the step of attaching a fastener strip of a crib toy to a fastener pad attached to the front side of the crib rail cover base.

11. The method of claim 8 further comprising the steps of:

d) placing a mesh side attached to and extending from the bottom edge of the crib rail cover base along the inside of the crib rail;

e) placing a bumper base attached to and extending from the mesh side onto a crib mattress support surface of the crib; and f) placing a crib mattress onto the crib mattress support surface.

12. The method of claim 8, wherein the first distance is about two inches.

13. The crib safety product of claim 2 further comprising a crib toy comprising a fastener strip reversibly attachable to the fastener pad of the crib rail cover base.

14. The crib safety product of claim 1, wherein the first distance is about two inches.

15. A method of assembly of a crib safety product, comprising a crib rail cover base having a front side, a back side opposite the front side, a top edge, a bottom edge opposite the top edge, and a pair of opposing side edges, at least one fastener strap comprising a pair of fastener strips fastened to and extending from the back side of the crib rail cover base, and at least one tie strap comprising a pair of tie strips fastened to and extending from the top edge of the crib rail cover base, the crib rail cover base having at least one opening through the crib rail cover base sized and located a first distance from the bottom edge to receive the tie strips, to a crib rail of a crib, the method comprising the steps of:

a) placing the crib rail cover base on a top rail of the crib rail with the back side facing the top rail, the top edge inside the crib, and the bottom edge outside the crib;

b) wrapping the fastener strap around the top rail and fastening each pair of fastener strips to each other to form a loop; and c) inserting each tie strip through its corresponding opening and tying the pair of tie strips together such that the bottom edge of the crib rail cover base is shifted upward with respect to the crib rail, thereby preventing a child from rolling over into the crib safety product and suffocating.

16. The method of claim 15, wherein each pair of fastener strips is a hook fastener strip and a loop fastener strip and in step b) the hook fastener strip is fastened to the loop fastener strip of each fastener strap to form the loop.

17. The method of claim 15 further comprising the step of attaching a fastener strip of a crib toy to a fastener pad attached to the front side of the crib rail cover base.

18. The method of claim 15 further comprising the steps of:

d) placing a mesh side attached to and extending from the bottom edge of the crib rail cover base along the inside of the crib rail;

e) placing a bumper base attached to and extending from the mesh side onto a crib mattress support surface of the crib; and f) placing a crib mattress onto the crib mattress support surface.

19. The method of claim 15, wherein the first distance is about two inches.

20. The method of claim 19, wherein the at least one opening through the crib rail cover base is at least one pair of openings.

* * * * *